US006981910B1

(12) United States Patent
Goff

(10) Patent No.: US 6,981,910 B1
(45) Date of Patent: Jan. 3, 2006

(54) THROWING WHEEL ASSEMBLY

(76) Inventor: James R. Goff, 13199 S. 273 E. Ave., Coweta, OK (US) 74429

( * ) Notice: Subject to any disclaimer, the term of this patent is extended or adjusted under 35 U.S.C. 154(b) by 0 days.

(21) Appl. No.: 10/903,816

(22) Filed: Jul. 30, 2004

(51) Int. Cl.
*B24C 5/00* (2006.01)
*B24C 5/06* (2006.01)
*B24C 7/00* (2006.01)
*B21J 5/04* (2006.01)

(52) U.S. Cl. ..... 451/91; 451/95; 451/96; 72/53

(58) Field of Classification Search ..... 451/95, 451/96; 72/53; 241/296; 416/206, 207, 416/203, 244 R; 403/328, 337
See application file for complete search history.

(56) References Cited

U.S. PATENT DOCUMENTS 1,741,787 A * 12/1929 Moody ..... 415/185
2,108,005 A * 2/1938 Keefer ..... 451/89
2,204,635 A * 6/1940 Turnbull ..... 451/97
3,216,700 A * 11/1965 Bostock, Jr. ..... 416/216
3,436,867 A * 4/1969 Fuerst ..... 451/95
3,513,597 A * 5/1970 Bernard et al. ..... 451/98
3,745,711 A * 7/1973 Haberlin ..... 451/97
3,867,791 A 2/1975 Goff
3,977,128 A 8/1976 Goff
3,977,515 A * 8/1976 Lewoczko ..... 198/677
4,047,843 A * 9/1977 Zeidler et al. ..... 416/185
4,050,850 A * 9/1977 Beckershoff ..... 416/221
4,176,502 A * 12/1979 Leliaert ..... 451/97
4,207,712 A * 6/1980 Toedtli ..... 451/97
4,244,150 A 1/1981 Goff
4,249,350 A * 2/1981 Goff ..... 451/97
4,333,276 A 6/1982 Goff
4,751,798 A * 6/1988 McDade ..... 451/95
5,081,801 A * 1/1992 Fylak ..... 451/97
5,209,024 A * 5/1993 Carpenter et al. ..... 451/95
5,501,575 A * 3/1996 Eldredge et al. ..... 416/144
5,759,091 A * 6/1998 MacMillan ..... 451/95
6,447,378 B1 * 9/2002 Hoff ..... 451/95

FOREIGN PATENT DOCUMENTS

WO WO 02/28594 A1 4/2002

* cited by examiner

*Primary Examiner*—Jospeh J. Hail, III
*Assistant Examiner*—Bryan Muller
(74) *Attorney, Agent, or Firm*—Dennis D. Brown; Fellers, Snider, Blankenship, Bailey & Tippens, P.C.

(57) ABSTRACT

A throwing wheel assembly including a rotatable wheel and one or more throwing blades each removably positionable on the face of the wheel in a throwing position, the throwing blades having holding structures projecting therefrom and the improvement comprising one or more retainers which are removably positionable in a recess provided in the wheel face and which and are adapted for removably receiving and retaining the blade holding structures.

21 Claims, 8 Drawing Sheets

THROWING WHEEL ASSEMBLY

FIELD OF THE INVENTION

The present invention relates to throwing wheel assemblies for blasting machines.

BACKGROUND OF THE INVENTION

Centrifugal blasting machines are commonly used in the art to strip or clean metal castings and other items. Centrifugal blasting machines typically employ a throwing wheel assembly comprising a plurality of throwing elements, referred to as throwing blades, mounted on the face of a rotator, runnerhead, or other rotatable wheel element. The throwing blades are adapted for receiving a stream of abrasive particulate material and throwing the particulate material radially outward from the wheel at an appropriate discharge point.

Because of the action of the abrasive material within the centrifugal blasting apparatus, the throwing blades will commonly undergo considerable wear and must be replaced periodically. To avoid having to replace the entire throwing wheel assembly, the blades must be removably mounted on the throwing wheel. Unfortunately, in order to provide a sufficiently secure attachment for the blasting operation, the blade attachment assemblies used heretofore typically have not allowed the blade elements to be quickly and easily removed and replaced. The removal and replacement of the blade elements often requires special tools, as well as the extensive disassembly of other parts of the device.

A more recent prior art throwing wheel assembly 10 which both (a) provides for the secure attachment of the blades to the throwing wheel and (b) allows the blades to be quickly removed and replaced, is depicted in FIGS. 1–4. The prior art assembly 10 can be used with any length or width of blade, does not require the machining and close tolerances characteristic of previous devices, reduces the number of costly machined parts required for attaching the blades, allows the use of bi-directional throwing blades, and requires no tools for removing or installing the blades.

The prior art assembly 10 comprises: a throwing wheel 13 having an axis of rotation 11; a hub or rotor 12 affixed to throwing wheel 13; a plurality of throwing blades 14 which are removably mounted on, and are perpendicular to, the face 9 of throwing wheel 13; and an impeller 23 centrally mounted on hub 12 between the inlet ends 16 of the throwing blades 14. The blades 14 generally extend radially away from the impeller 23.

The impeller 23 is rotatably affixed to hub 12 for receiving a stream of abrasive particulate blasting material from a spout 20 and feeding the abrasive material to the throwing blades 14. The impeller 23 is provided with openings 24 for delivering the abrasive material through a discharge opening 25 provided in the impeller case 21. The abrasive material is received on the inlet ends 16 of the blades 14 as the blades 14 rotate past the opening 25. The abrasive material moves outwardly along the throwing surface 15 of the blade 14 and is thrown from the distal end 17 of the throwing surface 15 at a desired discharge point.

Each of the throwing blades 14 comprises: an inner lateral side 30 positionable on the face 9 of wheel 13; an outer lateral side 29 opposite side 30; a first holding structure 26 which projects laterally outward from the lower end of side 30; and a second holding structure 27 which projects laterally outward from the upper portion of side 30. The blade 14 is a one-piece component with holding structures 26 and 27 being integral features thereof. The upper holding structure 27 is a rigid lug or arm which is receivable in a corresponding detent 40 provided in the periphery of the throwing wheel 13. A bore 45 extends radially inward from detent 40 for receiving a spring or other biasing element 95. The upper holding structure 27 includes a cavity or recess 90 in the bottom thereof for receiving and engaging the upper end of the biasing element 95.

The lower holding structure 26 of blade 14 includes outer lip portions 50 which hook or project upwardly toward the upper discharge end 17 of the blade 14 and are adapted to engage corresponding counter lip structures 51 formed in the face 9 of wheel 13. The counter lip structures 51 are contained within a lower detent 53 formed in face 9. The biasing element 95 continuously acts against the upper holding structure 27 to urge the blade 14 radially outward so that the lips 50 or other locking features of the lower holding structure 26 are held in locking engagement with the corresponding lips 51 or other locking features provided detent 53.

In the prior art assembly 10, each blade 14 can be easily attached to the throwing wheel 13 by placing the upper holding structure 27 in one of the outer detents 40, pushing the blade downward to compress the biasing element 95, pivoting the bottom of the blade 14 inward to place the lower holding structure 26 in the detent 53 and to align locking features 50 with locking features 51, and then releasing the compressive force applied to biasing element 95 so that the biasing element 95 acts to urge the blade 14 radially outward to thereby hold the lower holding structure 26 in locked engagement with the wheel 13. The blade 14 can be easily removed from wheel 13 by simply reversing this procedure.

Thus, the locking mechanism of the prior art assembly 10 holds the blades 14 securely during operation but allows the blades to be quickly and easily removed and replaced without the use of special tools and without any significant disassembly of the blasting machine. Unfortunately, however, the lower detents 53 and/or the locking features 51 formed in the face 9 of wheel 13 for receiving and retaining the lower holding structure 26 of blades 14 are exposed to significant abrasive contact and can be highly susceptible to wear. Whenever significant erosion at one or more of these attachment sites occurs, the entire throwing wheel 13 must be replaced.

Consequently, a need exists for an improved throwing wheel assembly which provides all of the benefits of the prior art assembly 10 but alleviates the wheel erosion problems. A need particularly exists for an improved throwing wheel assembly of this type which would further extend the life and reduce the cost of the wheel, eliminate the need to perform extensive millwork on the wheel, and allow the wheel to be formed from materials which are more highly abrasion resistant.

SUMMARY OF THE INVENTION

The present invention satisfies the needs and alleviates the problems discussed above. In one aspect, there is provided an improved throwing wheel assembly including a rotatable wheel and a throwing blade removably positionable on a face of the rotatable wheel in a throwing position, the throwing blade having a holding structure projecting therefrom. The improvement comprises: (a) the face having a recess therein and (b) the throwing wheel assembly further comprising a retainer which is removably positionable in the recess and is adapted for removably receiving the holding structure such that the retainer will retain the throwing blade in the throwing position.

In another aspect, there is provided an improved throwing wheel assembly including a rotatable wheel having an axis of rotation and a plurality of throwing blades, each of the throwing blades being removably positionable on a face of the rotatable wheel in a throwing position and each of the throwing blades also having a holding structure projecting therefrom. The improvement comprises (a) the face having a recess therein extending around the axis of rotation and (b) the throwing wheel assembly further comprising a plurality of retainers removably positionable in the recess, each of the retainers being adapted to removably receive the holding structure of a corresponding one of the throwing blades such that the retainers will retain each of the throwing blades in the throwing position.

Further aspects, features, and advantages of the present invention will be apparent to those skilled in the art and upon examining the accompanying drawings and upon reading the following detailed description of the preferred embodiments.

DESCRIPTION OF THE PREFERRED EMBODIMENTS

Figure 1:
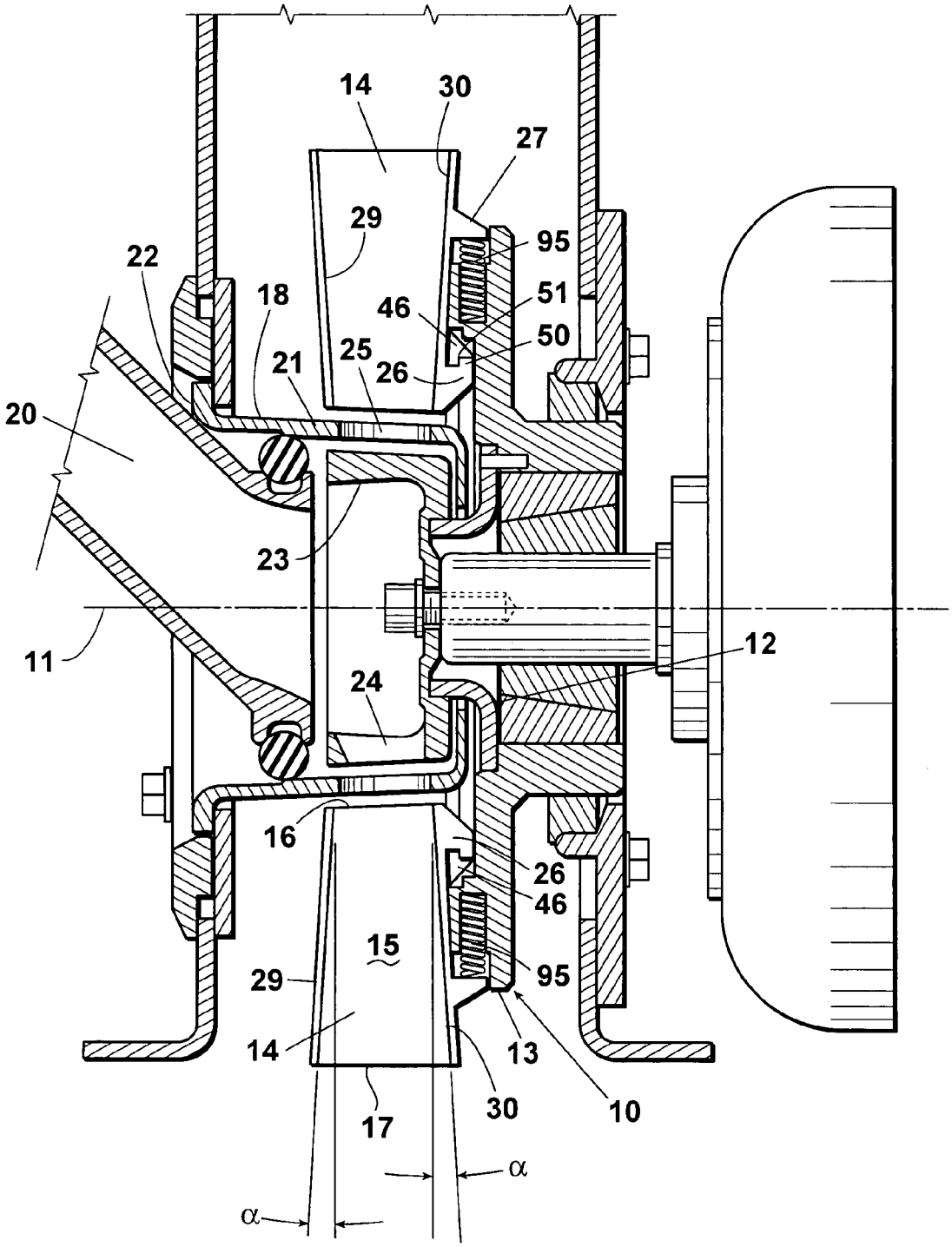
Fig. 1 ( PRIOR ART )
FIG. 1 is a cutaway elevational view of a prior art throwing wheel assembly 10.
Figure 3:
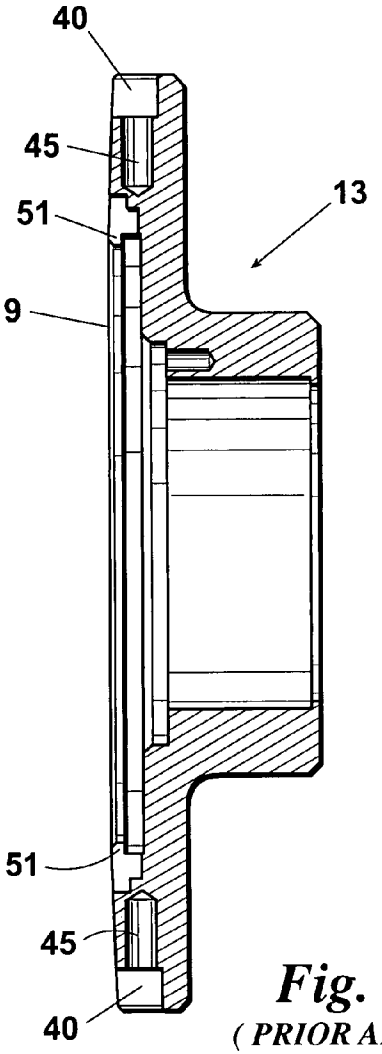
Fig. 3 ( PRIOR ART )
FIG. 3 is a cutaway elevational side view of the throwing wheel 13 as seen from perspective I—I shown in FIG. 2.
Figure 2:
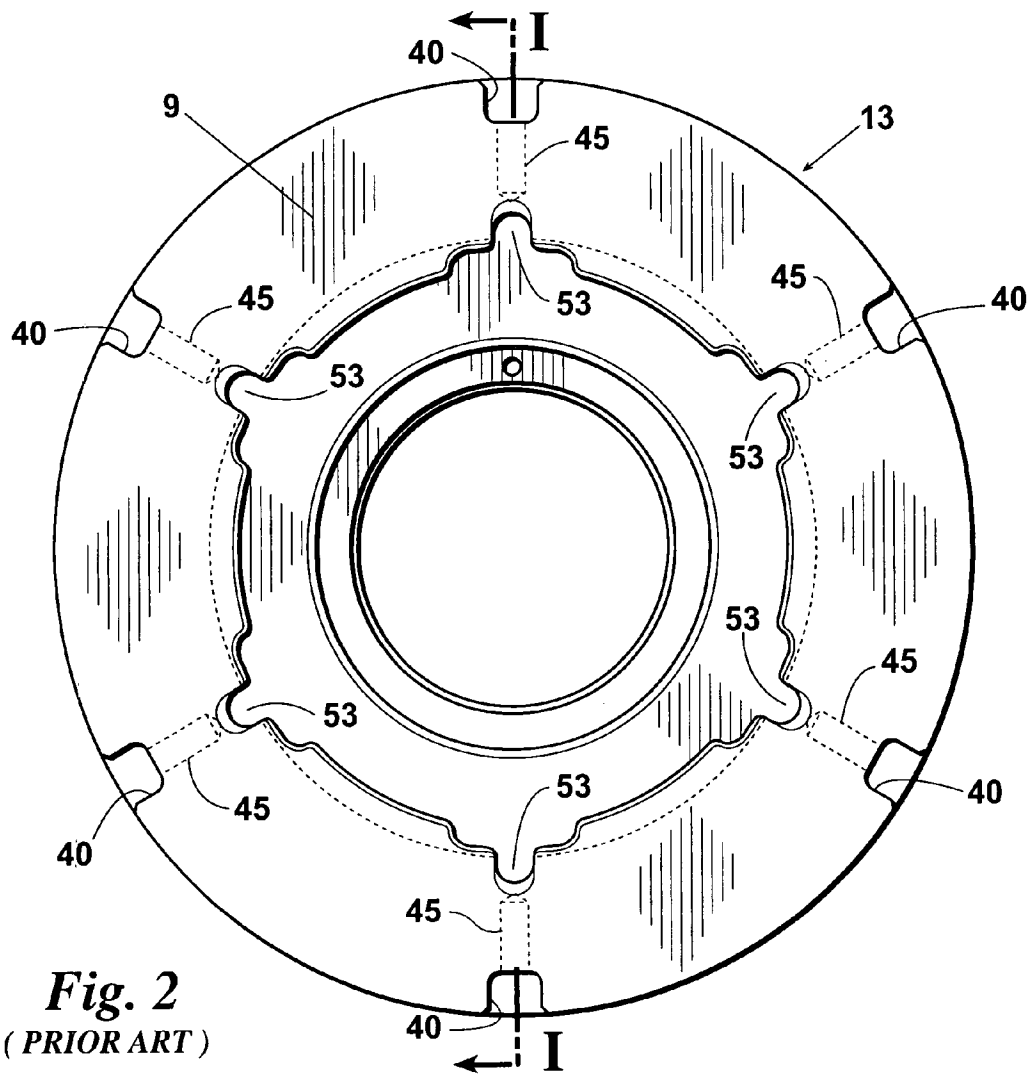
Fig. 2 ( PRIOR ART )
FIG. 2 is an elevational view of the face 9 of a throwing wheel 13 employed in prior art assembly 10.
Figure 8:
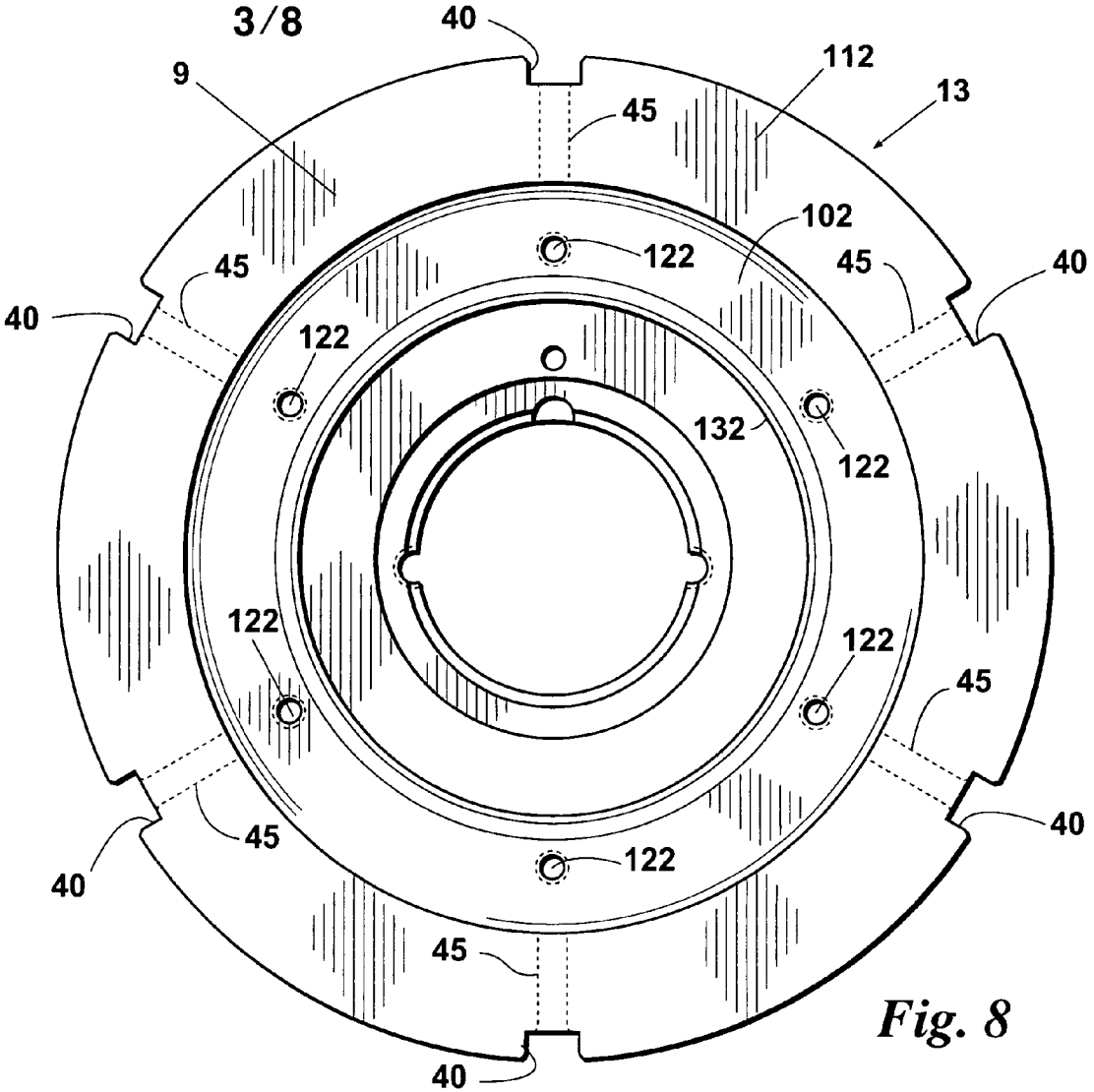
FIG. 8 is a front elevational face view of a modified throwing wheel 13 employed in inventive assembly 100.
Figure 4:
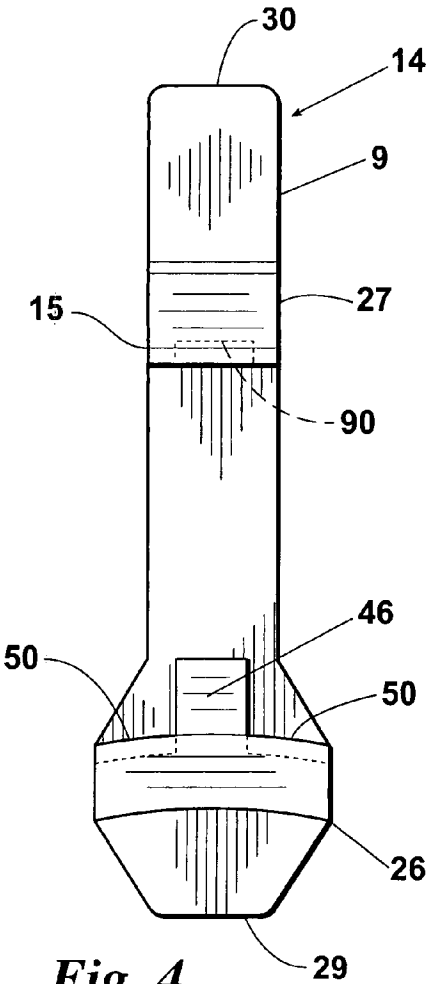
Fig. 4 (PRIOR ART)
FIG. 4 is an elevational view of the inner lateral side 30 of a throwing blade 14 employed in prior art assembly 10.

An embodiment 100 of the inventive improved throwing wheel assembly is depicted in FIGS. 5–15. The embodiment 100 of the improved inventive assembly is essentially identical to the prior art assembly 10 except that, rather than forming lower detents 53 and locking features 51 in the face 9 of the throwing wheel, the inventive improvement comprises: (a) a circular recess 102 which is formed in face 9 and extends around the axis of rotation 11 of throwing wheel 13 and (b) one or more retainers 104 which are removably secured in recess 102. If a plurality of retainers 104 are used, the improved throwing wheel assembly 100 can also optionally include one or more spacers 106 positioned in recess 102 between the retainers 104.

Figure 5:
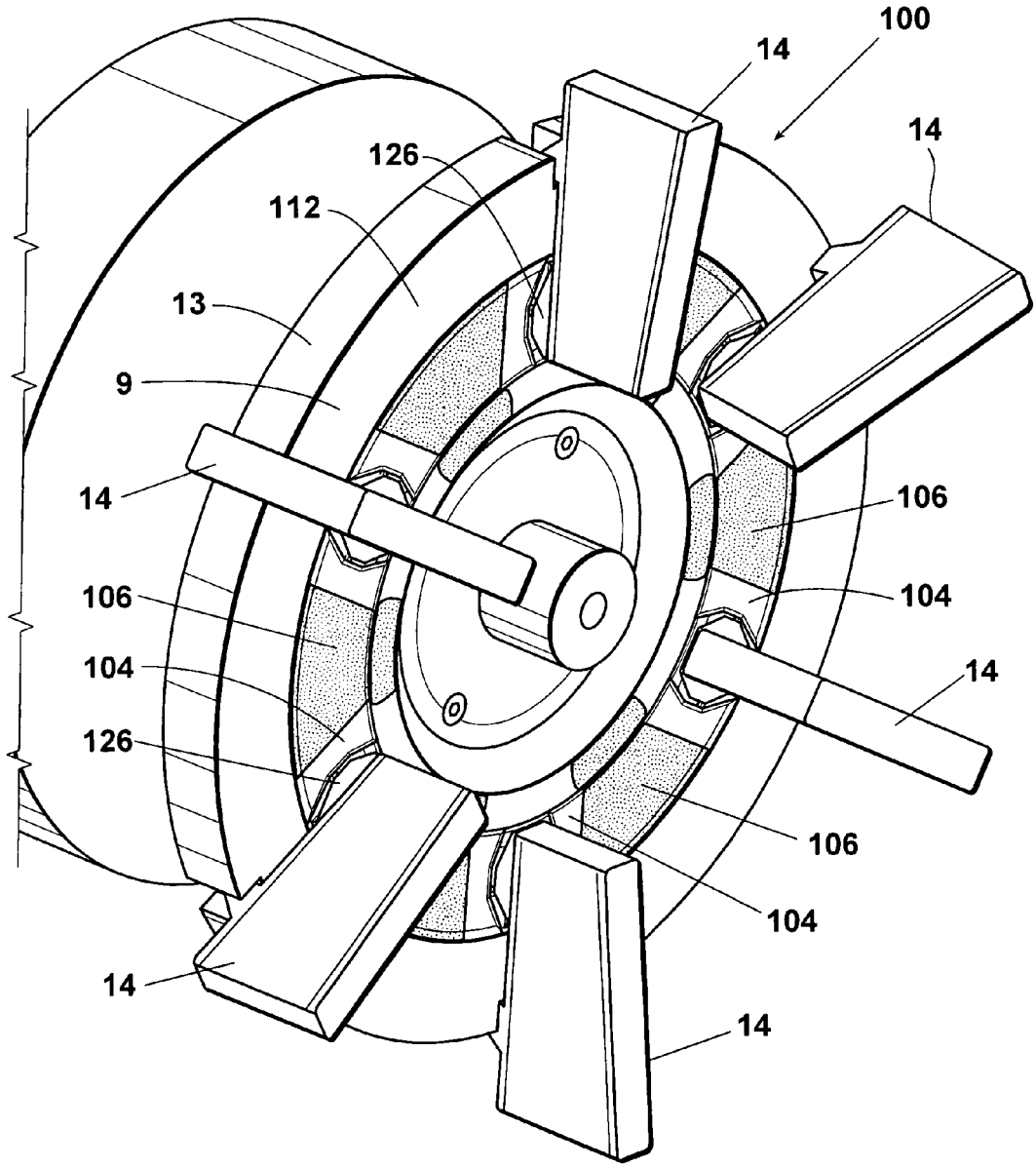
FIG. 5 is a perspective view of an inventive improved throwing wheel assembly 100.
Figure 6:
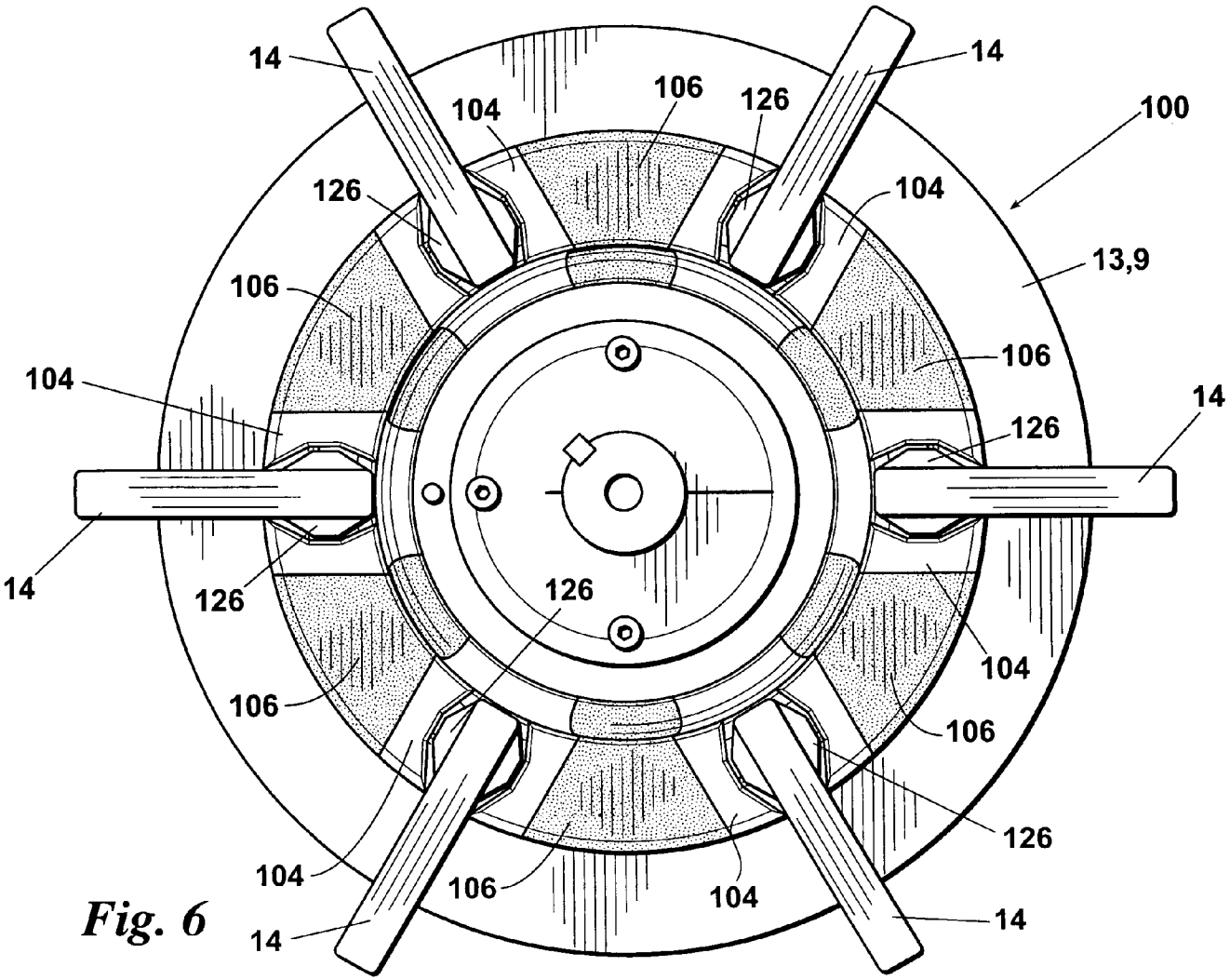
FIG. 6 is a front elevational view of inventive assembly 100.
Figure 7:
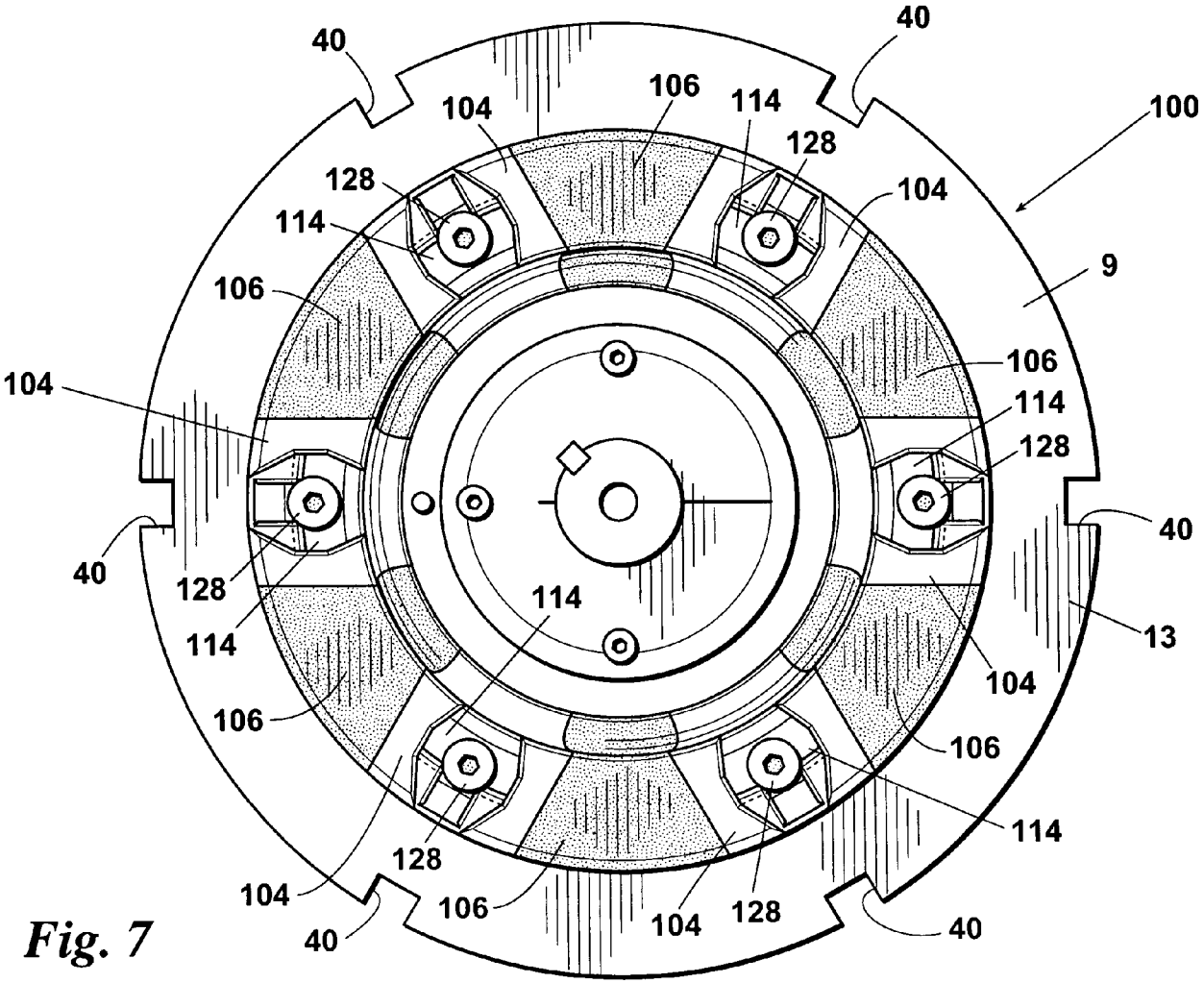
FIG. 7 is an elevational face view of inventive assembly 100 without any throwing blades positioned thereon.
Figure 9:
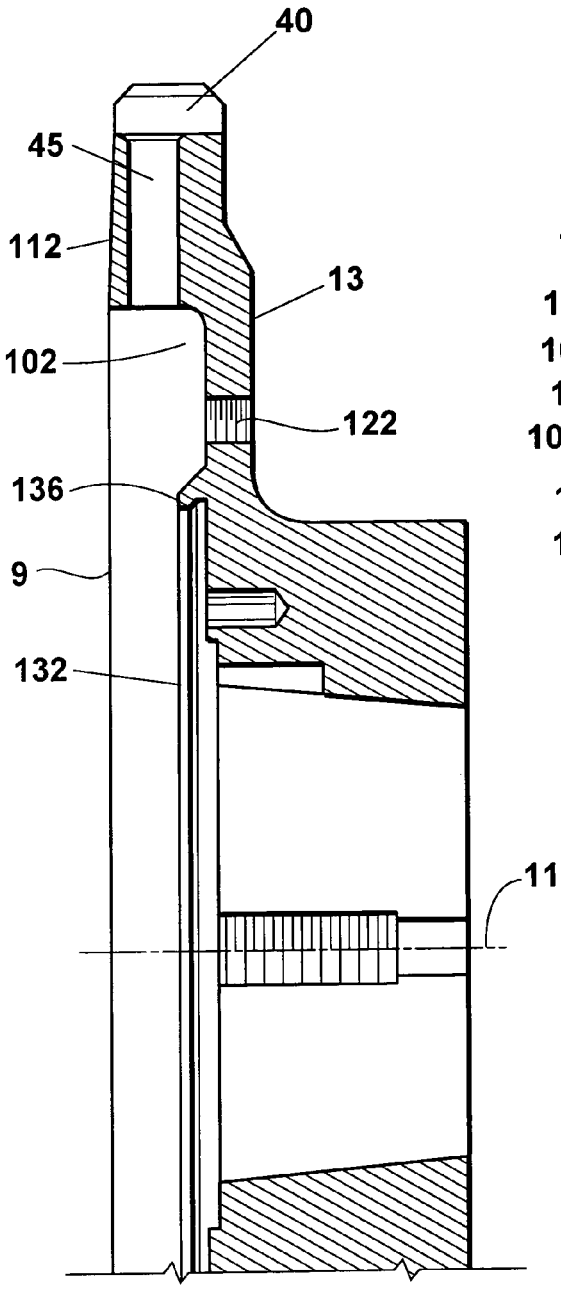
FIG. 9 is a cutaway elevational side view of the modified throwing wheel 13.
Figure 10:
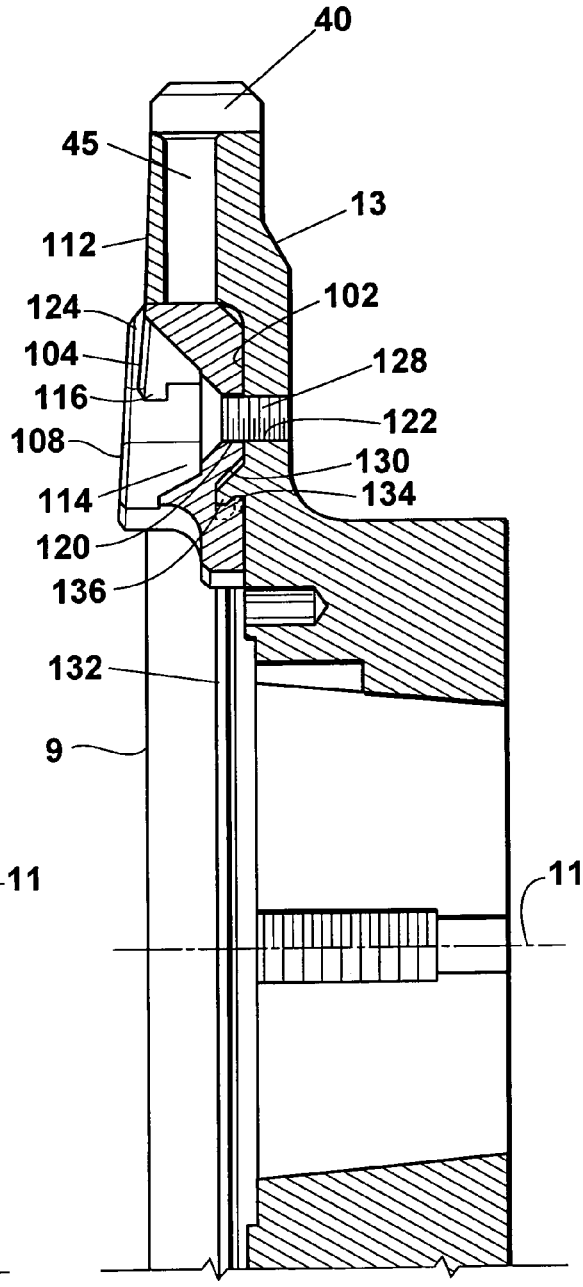
FIG. 10 is a cutaway elevational side view of a novel retainer element 104 installed within the recess 102 of the modified throwing wheel 13.
Figure 15:
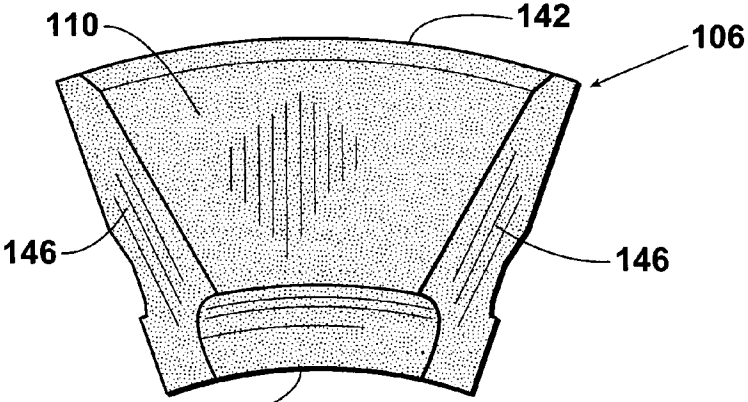
FIG. 15 is a plan view of a spacer 106 employed in inventive assembly 100.
Figure 13:
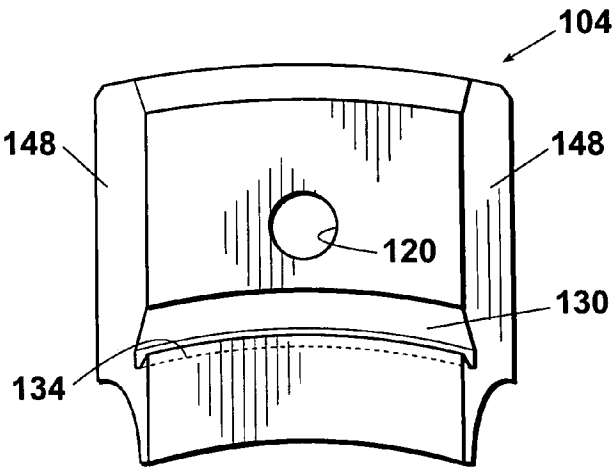
FIG. 13 is a bottom view of retainer 104.
Figure 12:
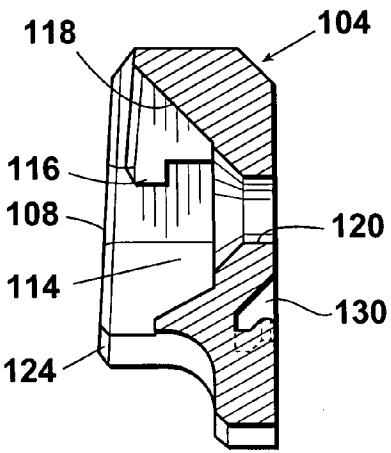
FIG. 12 is a cutaway elevational side view of retainer 104.
Figure 14:
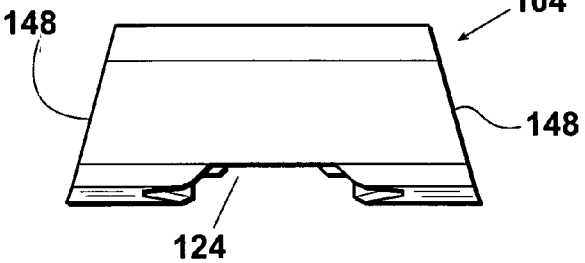
FIG. 14 is an elevational outer end view of retainer 104.
Figure 11:
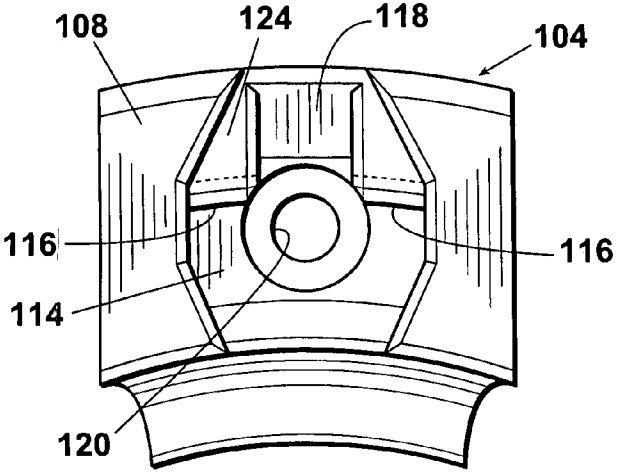
FIG. 11 is a plan view of retainer 104.

The embodiment 100 of the improved throwing wheel assembly shown in FIGS. 5 and 6 includes six retainers 104 and blades 14 with a corresponding number of spacers 106 positioned between the retainers 104 such that the retainers 104 and spacers 106 form a ring around the axis of rotation 11. The retainers 104, spacers 106, and recess 102 are all preferably configured and sized such that the forward outer faces 108 and 110 of the retainers 104 and spacers 106 either do not protrude from the face 9 of wheel 13 or do not protrude from the wheel face 9 to any great degree (i.e., preferably not more than ¼ inch, and more preferably not more than 0.2 inches, beyond the outer peripheral surface 112 of wheel face 9).

Each of the retainers 104 preferably comprises: a cavity 114 formed in the outer face 108 of the retainer 104 for receiving the lower holding structure 26 of a throwing blade 14; lip structures 116 or other locking features within cavity 114 which correspond to, and mate with, the upwardly projecting lip structures 50 or other locking features of the lower holding structure 26; a sloped interior channel 118 formed between the interior lips 116 for receiving the sloped gusset feature 46 of the lower holding structure 26; a bore 120 formed through the bottom of cavity 114 for alignment with a corresponding bore 122 formed in wheel 13; and an outer recessed portion 124 of cavity 114 which allows the wide initial portion 126 of lower holding structure 26 to be substantially fully received in cavity 114 such that the holding structure 26 will be substantially flush with the outer face 108 of the retainer 104 and the inner lateral side 30 of the blade 14 will lie substantially flat against the outer peripheral surface 112 of the wheel face 9.

Each retainer 104 is preferably held in place in recess 102 by a flathead bolt 126 which extends through the cavity bore 120 and into a corresponding bore 122 formed in wheel 13. During operation, the bolt 128 is covered by the blade holding structure 26 so that the bolt is shielded from the abrasive material. To further assist in holding the retainer 104 in place, a groove 130 can be formed across the back of retainer 104 for receiving a circular rim 132 formed on wheel 13. The retainer groove 130 includes an upwardly projecting lip 134 which mates with a corresponding lip 136 formed on rim 132 to prevent the retainer 104 from moving radially outward.

The inventive throwing wheel assembly 100 can be adapted to accommodate either a single throwing blade 14 or a plurality of throwing blades 14. To maximize the number of throwing blades 14 used, the recess 102 of wheel face 9 can be filled with a desired number of retainers 104 having no spacers 106 positioned therebetween. To reduce the number of throwing blades 14 employed, spacers 106 will preferably be positioned between retainers 104 and the width of the spacers 106 will be selected as necessary to accommodate the desired number of throwing blades 14 and to provide the desired spacing therebetween. The spacers 106 protect the wheel 13 and the retainers 104 from abrasive contact and also assist in holding the retainers 104 in fixed position. The recess 102 will preferably be filled with retainers 104 or with a combination of retainers 104 and spacers 106 so as to form a ring around the axis of rotation 11.

Each spacer 106 has an arcuate inner edge 140 and an arcuate outer edge 142 which match the size and curvature of recess 102. A groove (not shown) is formed in the back of each spacer 106 to receive and accommodate the circular rim 132 projecting from the wheel face 9. To hold the spacers in place, each spacer preferably has beveled sides 146 which diverge toward the wheel face 9. The inwardly diverging sides 146 of the spacers 106 are received under corresponding, outwardly diverging sides 148 of the retainers 104 so that the bolted retainers 104 will hold the spacers 106 in place.

With the desired number of retainers 104 and spacers 106 secured within the wheel recess 102, the inventive improved throwing wheel assembly operates in the same manner as the prior art assembly 10. The upper holding structures 27 projecting from the blades 14 are removably positionable in the outer peripheral detents 40 formed in the wheel 13 such that the biasing elements 95 positioned in bores 45 will urge the blades 14 radially outward and thereby hold the lower holding structures 26 of the blades 14 in locked engagement with the retainers 104. As with assembly 10, the blades 14 of the inventive assembly 100 can be removed and replaced by simply pushing the blades 14 radially inward to temporarily depress the biasing elements 95.

Although the inventive throwing assembly 100 has been described as used in conjunction with the throwing blades 14 of the prior art assembly 10, it will be understood that the inventive assembly could alternatively be used with throwing blades having other configurations. Each of the throwing blades 14 of the prior art assembly 10 is a bi-directional blade having a flat front throwing surface 15 and a flat rear surface 9. In addition, the sides 29 and 30 of the blades 14 diverge slightly in the direction of flow such that the front and rear surfaces 15 and 19 are flared. However, the inventive throwing wheel assembly could alternatively be used, for example, with blades which are unidirectional (i.e., have only one throwing surface) and/or have a curved rather than flat throwing surface and/or have throwing surfaces which are straight rather than flared.

In addition, although the retainer cavities 114 of the inventive throwing assembly 100 have been formed to accommodate and correspond to the configuration of the lower holding structures 26 of the blades 14, it will be understood that the retainer cavities 114 can be adapted and configured to receive and retain generally any other type of holding structure configuration. Similarly, other types of biasing structures and elements can be employed for urging the projecting blade-holding structures 26 toward locked engagement with the retainers 104.

The inventive improved throwing wheel assembly 100 provides several advantages over the prior art assembly 10. The removable retainers 104 and spacers 106 employed in the inventive assembly shield the throwing wheel from abrasive contact. In the event that erosion occurs in the inventive locking mechanism, the user can simply replace the affected retainer 104 rather than replacing the entire throwing wheel. The present invention also eliminates the requirement for extensive millwork on the wheel and allows the wheel to be formed of more highly abrasion-resistant materials. Such materials have not typically been used heretofore for forming the throwing wheel because they are not readily machinable. The replaceable retainers 104 of the inventive assembly, on the other hand, can be formed from different materials which may be less expensive or better suited for the particular production and machining requirements of the retainers 104.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. A throwing wheel assembly including a rotatable wheel and a throwing blade removably positionable on a face of said rotatable wheel in a throwing position, said throwing blade having a holding structure projecting therefrom, the improvement comprising:

said face having a recess therein and said throwing wheel assembly further comprising a retainer which is removably positionable in said recess and is adapted for removably receiving said holding structure such that said retainer will retain said throwing blade in said throwing position, said retainer having a cavity therein wherein said holding structure is removably receivable, and said retainer being removably securable in said recess by a bolt which is covered by said holding structure when said holding structure is positioned in said cavity.

2. The throwing wheel assembly of claim 1 wherein said holding structure projects from a lateral side of said throwing blade.

3. The throwing wheel assembly of claim 1 wherein the improvement further comprises:

said holding structure being a fi holding structure and said throwing blade also having a second holding structure projecting therefrom for engagement with a biasing element which biases said first holding structure toward engagement with said retainer.

4. The throwing wheel assembly of claim 3 wherein said biasing element is positioned in a radial bore provided in an outer portion of said rotatable wheel.

5. The throwing wheel assembly of claim 3 further comprising:

a detent provided in an outer portion of said rotatable wheel for receiving said second holding structure and said biasing member is positioned in a bore extending radially into said rotatable wheel from said detent.

6. A throwing wheel assembly including a rotatable wheel having an axis of rotation and a plurality of throwing blades, each of said throwing blades being removably positionable on a face of said rotatable wheel in a throwing position and each of said throwing blades also having a holding structure projecting therefrom, the improvement comprising:

said face having a recess therein extending around said axis of rotation;

said throwing wheel assembly further comprising a plurality of retainers removably positionable in said recess, each of said retainers being adapted to removably receive said holding structure of a corresponding one of said throwing blades such that said retainers will retain each of said throwing blades in said throwing position; and a plurality of spacers removably positionable in said recess between said retainers.

7. The throwing wheel assembly of claim 6 wherein the improvement further comprises:

said retainers having sides which diverge in a first direction and said spacers having sides which diverge in a second direction opposite said first direction.

8. The throwing wheel assembly of claim 6 wherein the improvement further comprises:

said retainers having sides which converge toward said rotatable wheel and said spacers having sides which diverge toward said rotatable wheel.

9. The throwing wheel assembly of claim 6 wherein the improvement further comprises each of said retainers having a cavity wherein said holding structure of said corresponding one of said throwing elements is removably receivable.

10. The throwing wheel assembly of claim 9 wherein the improvement further comprises each of said retainers being removably securable in said recess by a bolt which is covered by said holding structure of said corresponding one of said throwing elements.

11. The throwing wheel assembly of claim 6 wherein the improvement further comprises said retainers and said spacers forming a ring which surrounds said axis of rotation.

12. The throwing wheel assembly of claim 6 wherein the improvement further comprises:

for each of said throwing blades, said holding structure is a first holding structure;

said throwing wheel assembly further comprises a plurality of biasing elements; and each of said throwing blades also has a second holding structure projecting therefrom for engagement with a corresponding one of said biasing elements which biases said first holding structure toward engagement with a corresponding one of said retainers.

13. The throwing wheel assembly of claim 12 wherein said biasing elements are positioned in radial bores provided in an outer portion of said rotatable wheel.

14. The throwing wheel assembly of claim 12 further comprising:

a plurality of detents in an outer portion of said rotatable wheel, each for receiving said second holding structure of a corresponding one of said throwing blades and said biasing members are positioned in bores extending radially into said rotatable wheel from said detents.

15. A throwing wheel assembly including a rotatable wheel having an axis of rotation and a plurality of throwing blades, each of said throwing blades being removably positionable on a face of said rotatable wheel in a throwing position and each of said throwing blades also having a first holding structure projecting therefrom, the improvement comprising:

said face having a recess therein extending around said axis of rotation and said throwing wheel assembly further comprising a plurality of retainers, said retainers being independent from each other so that they are separately positionable in and removable from said recess, and each of said retainers being adapted to removably receive said holding structure of a corresponding one of said throwing blades such that said retainers will retain each of said throwing blades in said throwing position and said throwing wheel assembly further comprises a plurality of biasing elements and each of said throwing blades also has a second holding structure projecting therefrom for engagement with a corresponding one of said biasing elements which biases said first holding structure toward engagement with a corresponding one of said retainers.

16. The throwing wheel assembly of claim 15 wherein said biasing elements are positioned in radial bores provided in an outer portion of said rotatable wheel.

17. The throwing wheel assembly of claim 15 further comprising:

a plurality of detents in an outer portion of said rotatable wheel, each for receiving said second holding structure of a corresponding one of said throwing blades and said biasing members are positioned in bores extending radially into said rotatable wheel from said detents.

18. A throwing wheel assembly including a rotatable wheel and a throwing blade removably positionable on a face of said rotatable wheel in a throwing position, said throwing blade having a holding structure projecting therefrom, the improvement comprising said face having a recess therein and said throwing wheel assembly further comprising a retainer which is removably positionable in said recess and includes a cavity for removably receiving said holding structure such that said retainer will retain said throwing blade in said throwing position, wherein, when said retainer is positioned in said recess in said face and said holding structure of said throwing blade is received in said cavity of said retainer, said cavity and said holding structure will extend into said recess.

19. The throwing wheel assembly of claim 18 wherein said throwing blade has a throwing surface which will be substantially perpendicular to said face and a lateral side which will be positioned adjacent to said face and wherein said holding structure projects from said lateral side of said throwing blade.

20. The throwing wheel assembly of claim 19 wherein the improvement further comprises a portion of said lateral side contacting said face when said retainer is positioned in said recess and said holding structure is received in said cavity.

21. The throwing wheel assembly of claim 19 wherein the improvement further comprises a portion of said lateral side lying substantially flat against said face when said retainer is positioned in said recess and said holding structure is received in said cavity.

* * * * *